US009414144B2

(12) United States Patent
Mathis

(10) Patent No.: US 9,414,144 B2
(45) Date of Patent: Aug. 9, 2016

(54) MICROPHONE POSITIONING SYSTEM

(71) Applicant: Stuart Mathis, Brentwood, TN (US)

(72) Inventor: Stuart Mathis, Brentwood, TN (US)

( * ) Notice: Subject to any disclaimer, the term of this patent is extended or adjusted under 35 U.S.C. 154(b) by 144 days.

(21) Appl. No.: 14/179,846

(22) Filed: Feb. 13, 2014

(65) Prior Publication Data

US 2014/0233764 A1 Aug. 21, 2014

Related U.S. Application Data

(60) Provisional application No. 61/767,479, filed on Feb. 21, 2013.

(51) Int. Cl.
*H04R 1/08* (2006.01)

(52) U.S. Cl.
CPC ..... *H04R 1/08* (2013.01); *H04R 2201/025* (2013.01); *H04S 2400/15* (2013.01)

(58) Field of Classification Search
None
See application file for complete search history.

(56) References Cited

U.S. PATENT DOCUMENTS

| | | | | |
|---|---|---|---|---|
| 2,969,436 | A | 1/1961 | Kilyk et al. | |
| 3,007,014 | A | 10/1961 | Bentman | |
| 4,961,177 | A | 10/1990 | Uehara | |
| 5,611,508 | A | 3/1997 | Palmero | |
| 6,788,337 | B1 * | 9/2004 | Fujii | H04N 7/142 348/14.08 |
| 7,317,872 | B1 | 1/2008 | Posa et al. | |
| 7,545,410 | B2 | 6/2009 | Oka et al. | |
| 7,675,399 | B2 | 3/2010 | Ebrey | |
| 8,170,241 | B2 | 5/2012 | Roe et al. | |
| 2007/0154045 | A1 | 7/2007 | Basir | |
| 2007/0291123 | A1 | 12/2007 | Cole | |
| 2009/0112362 | A1 | 4/2009 | Nishi et al. | |
| 2010/0100240 | A1 | 4/2010 | Wang et al. | |
| 2010/0189273 | A1 | 7/2010 | Statham et al. | |
| 2011/0254954 | A1 | 10/2011 | Lee et al. | |
| 2011/0311083 | A1 | 12/2011 | Bennett | |
| 2012/0027226 | A1 | 2/2012 | Desenberg | |
| 2012/0050527 | A1 | 3/2012 | Lee et al. | |
| 2012/0067197 | A1 * | 3/2012 | May | H04R 1/08 84/723 |

FOREIGN PATENT DOCUMENTS

| | | | |
|---|---|---|---|
| JP | 58063820 A | * | 4/1983 |

* cited by examiner

*Primary Examiner* — Thang Tran
(74) *Attorney, Agent, or Firm* — Boyle Fredrickson, S.C.

(57) ABSTRACT

A microphone positioning system includes a microphone, a selectively operable turntable device to which the microphone is mounted, and a remote control device for selectively imparting rotation to the turntable device to selectively vary the angle of the microphone. The elevation of the microphone can also be varied, such as by means of an extendable and retractable support. The turntable device may be interconnected with an axially extending rail and is movable to varying positions along the rail such as by means of a carrier. A drive arrangement is interconnected between the rail and the carrier for moving the carrier along the length of the rail, and the drive arrangement is operable in response to the remote control device.

14 Claims, 7 Drawing Sheets

MICROPHONE POSITIONING SYSTEM

CROSS REFERENCE TO RELATED PATENT APPLICATIONS

This application is a non-provisional patent application and claims priority to U.S. Provisional Patent Application Ser. No. 61/767,479 filed Feb. 21, 2013, the disclosure of which is expressly incorporated herein.

BACKGROUND OF THE INVENTION

1. Field of the Invention

The present invention relates in general to the field of sound amplification and/or recording. More particularly, the present invention relates to a system for controlling the location or position of a device such as a microphone that is used in sound amplification and/or recording.

2. Discussion of the Related Art

It is known in the prior art to use a device such as a microphone to convert sound waves into electrical waves or signals for use in sound amplification and/or recording. A microphone is typically positioned on a stationary stand, which enables manual adjustment of the horizontal and vertical angles of the microphone as well as manual adjustment of the height of the microphone.

In musical performance, especially studio recording of vocals or musical instruments, variations in microphone position can make a significant difference in audible perception and sound reproduction. However, to adjust microphone position, it has been necessary in the past to manually move a microphone to a certain position, raise or lower the microphone stand, and adjust the horizontal or vertical angle of the microphone. This can be a tedious and time-consuming process when adjusting the position of a single microphone, which is compounded when a number of microphones are involved, which is often the case in studio recording.

SUMMARY AND OBJECTS OF THE INVENTION

It is an object of the present invention to provide a microphone positioning system that enables a microphone to be moved to a number of different positions or locations without having to directly physically position the microphone or the microphone support components. It is a further object of the invention to provide such a microphone positioning system that can be controlled remotely.

In accordance with the present invention, a microphone positioning system includes a microphone that is mounted on a turntable device, in combination with a remote control arrangement that is interconnected with the turntable device for varying the angle of the microphone, typically the horizontal angle. The turntable device may include a motor, such as a servo motor, which is able to cause movement of the turntable device about an axis of rotation, which is generally a vertical axis. The microphone may be mounted to the turntable device using a conventional microphone mount, which enables adjustment in the vertical angle of the microphone about a generally horizontal pivot axis. Adjustment in the vertical angle of the microphone may be accomplished manually or, alternatively, may be accomplished using a selectively extendable and retractable operator such as a linear actuator or hydraulic cylinder. With this arrangement, when the microphone is in a stationary location, the remote control can be operated to adjust the horizontal angle of the microphone by selectively rotating the turntable device. The vertical angle of the microphone can be adjusted by selectively extending a retracting the linear actuator or hydraulic cylinder.

The present invention also contemplates adding another dimension to adjustability in the position of a microphone. To accomplish this, the turntable device may be mounted to a carrier, which in turn is movably mounted to one or more rails. In one embodiment, the carrier may be mounted to a single rail that extends in a desired direction, such as in either a fore-and-aft direction or in a lateral direction. In another embodiment, the turntable device may be mounted to a pair of rails that are oriented transversely to each other. In the single rail embodiment, the remote control can be operated to move the carrier linearly along the length of the rail and at the same time operated to alter the vertical and/or horizontal angle of the microphone. In the dual-rail embodiment, the rails may each be movable along a pair of tracks, with the carrier being mounted at the intersection of the rails. The remote control can be operated to move one or both of the rails along the respective tracks, which allows the carrier to be moved to any location within a plane defined by the two rails, while at the same time adjusting the vertical and/or horizontal angle of the microphone. In another embodiment, a number of microphones may be mounted to a single rail for simultaneously picking up sounds at different locations along the length of the rail. In yet another embodiment, a number of non-intersecting rails may be employed, with one or more microphones being movably mounted to each rail for picking up sounds at one or more locations along the lengths of the rails.

The microphone position adjustment can be accomplished by a single operator from a remote location, which may be a recording engineer in a sound room. Alternatively, the microphone position adjustment can be accomplished by the musician himself.

Using the microphone position adjustment system of the present invention as summarized above, an operator can move one or more microphones throughout a wide range of positions while the operator remains stationary. The operator can thus try various microphone positions with very little effort, which enables the operator to find acoustically desirable microphone positions within a recording or performance space. This flexibility and convenience is highly desirable, since it can sometimes be the case that acoustically desirable microphone positions may be counterintuitive. For example, a desirable sound may be obtained when a microphone is positioned near a wall and pointing away from an amplifier, as opposed to being positioned near an amplifier and pointing toward it, as is more conventional.

These and other aspects and objects of the present invention will be better appreciated and understood when considered in conjunction with the following description and the accompanying drawings. It should be understood, however, that the following description, while indicating representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms in accordance with the present invention, will become more readily apparent by referring to the exemplary, and therefore non-limiting, embodiments illustrated in the drawings accompanying and forming a part of this specification, wherein like reference numerals designate the same elements in the several views.

In the drawings.

Figure 1:
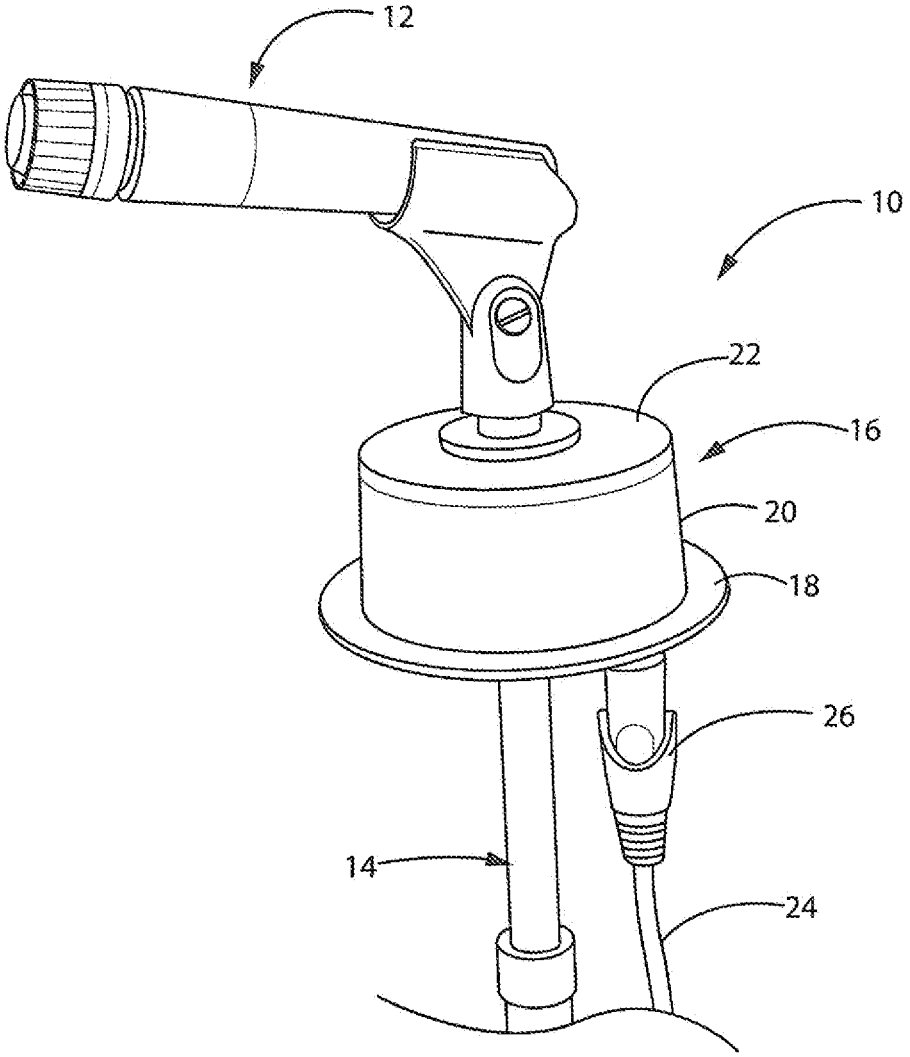
FIG. 1 is an isometric view of a first embodiment of a microphone positioning system in accordance with the present invention.

In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION

The present invention and the various features and advantageous details thereof are explained more fully with reference to the non-limiting embodiments described in detail in the following description.

Referring to FIG. 1, a first embodiment of a microphone positioning system 10 constructed in accordance with the present invention generally includes a microphone 12, a microphone stand 14, and a turntable assembly 16 positioned between microphone 12 and the upper end of microphone stand 14. Turntable assembly 16 includes a base 18 secured to the upper end of microphone stand 14, a cylindrical housing 20 connected to base 18, and a rotatable plate 22 that overlies the upper end of housing 20. A rotating drive mechanism, such as a servomotor, is positioned within the interior of housing 20. The output of the drive mechanism, such as the motor output shaft, is secured to rotatable plate 22. Preferably, the motor is operable to provide full 360 degree rotation of rotatable plate 22 about its axis of rotation. Base 20 includes an input jack or other such connector, and a control cable 24 is secured to the input jack of base 20 via an output jack 26 or other such connector that mates with the input jack of base 20.

Figure 2:
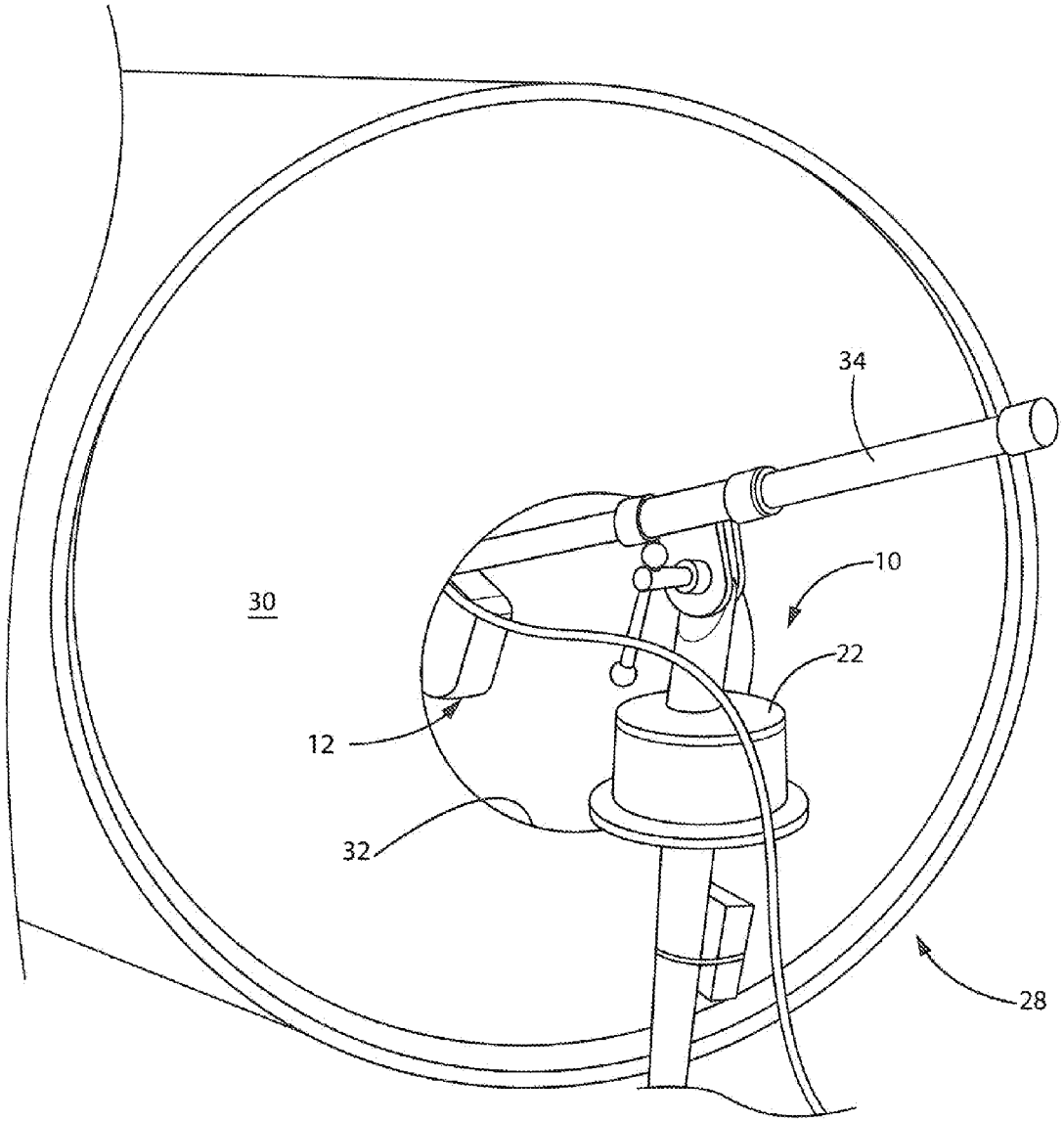
FIG. 2 is an isometric view showing a representative application of the microphone positioning system of FIG. 1.

FIG. 2 illustrates a representative application of microphone positioning system 10 as shown in FIG. 1. In this application, microphone positioning system, 10 is used to pick up sound from the interior of a kick drum 28. In a manner as is known, kick drum 28 includes a drum head 30 provided with an opening 32. Microphone positioning system 10 is located adjacent the outer surface of drum head 30. In this embodiment, microphone 12 is mounted at the end of a small microphone boom 34, which can be extended and retracted relative to rotatable plate 22 so as to position microphone 12 within the drum interior through opening 32. Microphone 12 is angularly movable about the axis of rotation of rotatable plate 22, which enables a user to vary the position of microphone 12 within the interior of kick drum 28.

Figure 3:
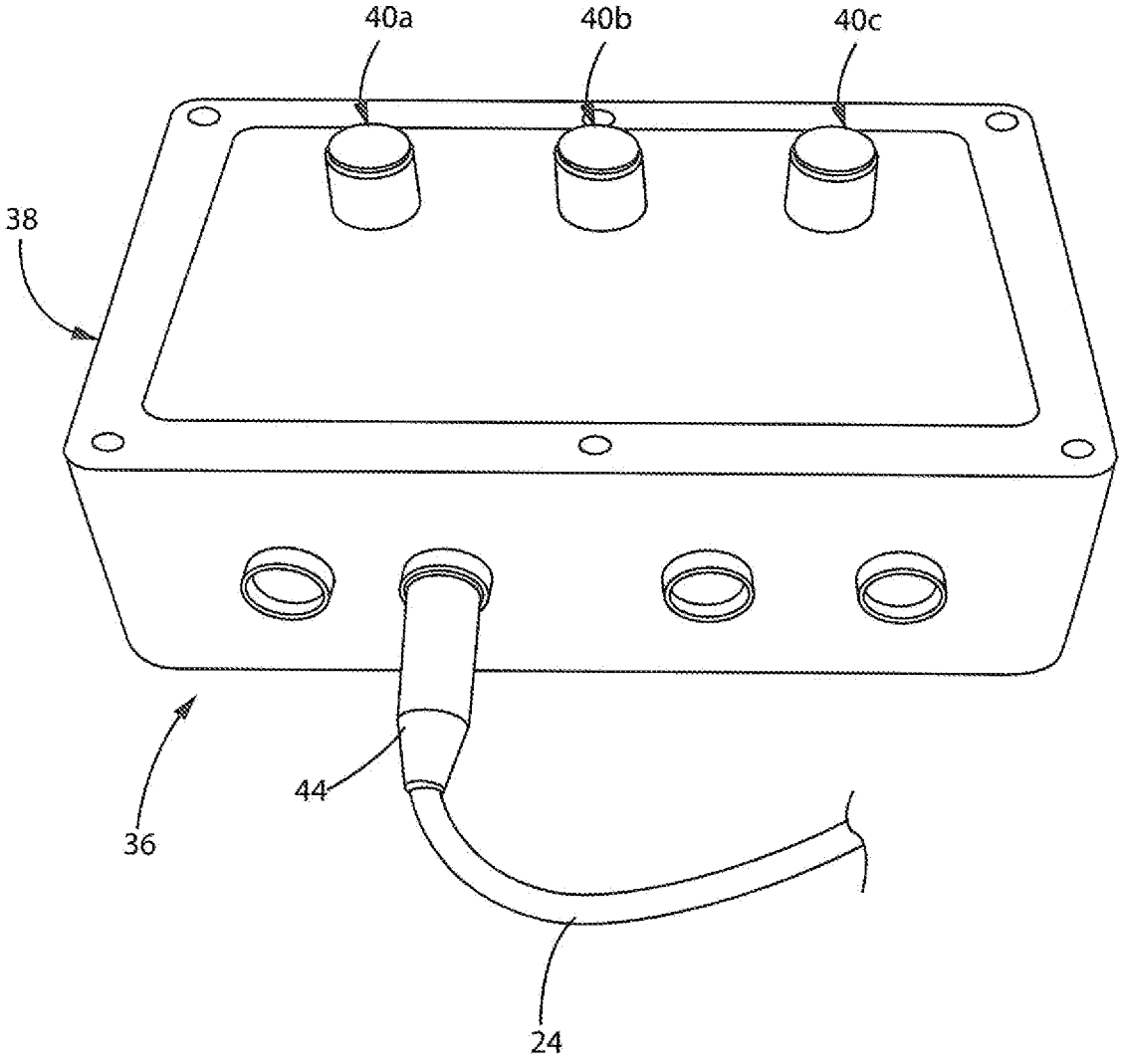
FIG. 3 is an isometric view of a remote control incorporated in the microphone positioning system of FIG. 1.

FIG. 3 illustrates a remote control unit 36 forming a part of microphone positioning system 10. Remote control unit 36 is in the form of a housing 38 to which a number of manually operable input members, such as knobs 40*a*, 40*b* and 40*c* are rotatably mounted. The knobs 40*a*, 40*b* and 40*c*, in turn, are interconnected with conventional variable output electrical components, such as rheostats or the like, contained within the interior of housing 38. Each variable output component, in turn, is interconnected with an output jack such as shown at 42*a*, 42*b*, 42*c* and 42*d* secured to the housing 38. Control cable 24 is interconnected with a selected one of output jacks 42*a*, 42*b*, 42*c* and 42*d* via a jack 44. In this manner, rotation of a selected one of knobs 40*a*, 40*b* and 40*c* provides an output signal that is communicated through the associated output jack such as 42*a*, 42*b*, 42*c* and 42*d*, control cable 24 and output jack 26 to the motor or other driver contained within the interior of cylindrical housing 20, to selectively impart rotation to rotatable plate 22 and thereby rotate microphone 12 to a desired position. In this manner, the user is able to listen to the sound picked up by microphone 12 while adjusting the position of microphone 12, for example within the interior of kick drum 28, to attain the desired sound output of kick drum 28. It is understood, however, that microphone 12 may be positioned so as to pick up sound from any location, whether directly from an instrument such as kick drum 28, or indirectly from speakers or other audio output devices from which sounds are emitted.

Figure 4:
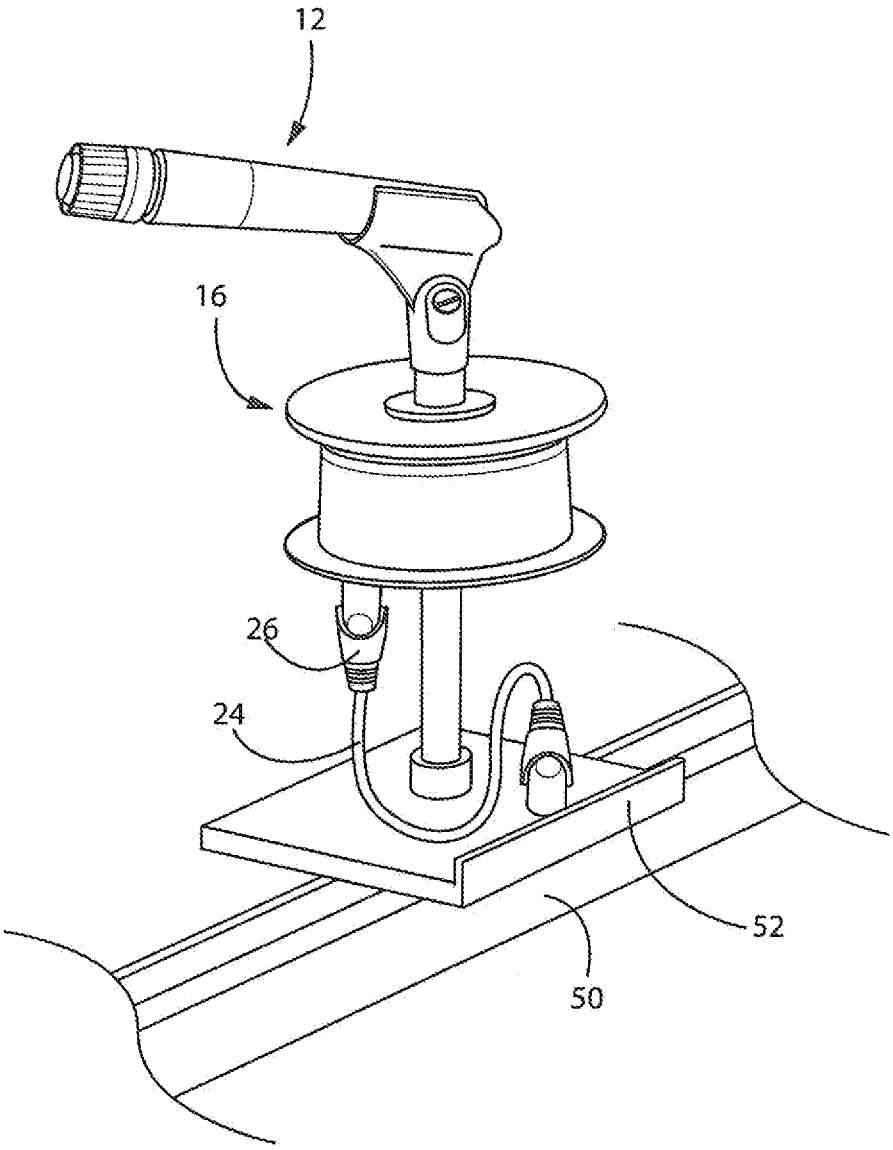
FIG. 4 is an isometric view of a second embodiment of a microphone positioning system in accordance with the present invention.

FIG. 4 illustrates another embodiment of a microphone positioning system in accordance with the present invention. In this embodiment, microphone 12 is mounted to turntable assembly 16, which in turn is mounted to a carrier 50 that is movable along a beam or rail 52. In this embodiment, carrier 50 is movable along the length of rail 52 so that turntable assembly 16, and thereby microphone 12, can be moved to any position along the length of rail 52. A wheel or bearing arrangement is interposed between carrier 50 and rail 52, to facilitate movement of carrier 50 along the length of rail 52. A satisfactory drive mechanism, such as a worm gear, linear actuator, hydraulic cylinder, chain drive or belt drive is interconnected between rail 52 and carrier 50 so as to enable carrier 50 to be moved along rail 52. Control cable 24 may be stored on a spool-type take-up arrangement in a manner as is known, which ensures that slack in cable 24 does not interfere with movement of carrier 50 along rail 52. One of the outputs of remote control unit 36 may be employed to control the position of carrier 50 along the length of rail 52.

Rail 52 may be positioned in any desired location within the space within which sounds are desired to be picked up by microphone 12. For example, rail 52 may be positioned in line with speakers or other audio output devices so as to vary the distance between microphone 12 and the speakers or other audio output devices. Rail 52 may also be positioned so as to extend transversely to the speakers or other audio output devices so as to vary the lateral position of the microphone 12 relative to the speakers or other audio output devices. Rail 52 may also be positioned so as to extend outwardly from or parallel to a surface such as a wall or the like within the space, to pick up sounds reflected by the surface at various locations as desired.

Figure 5:
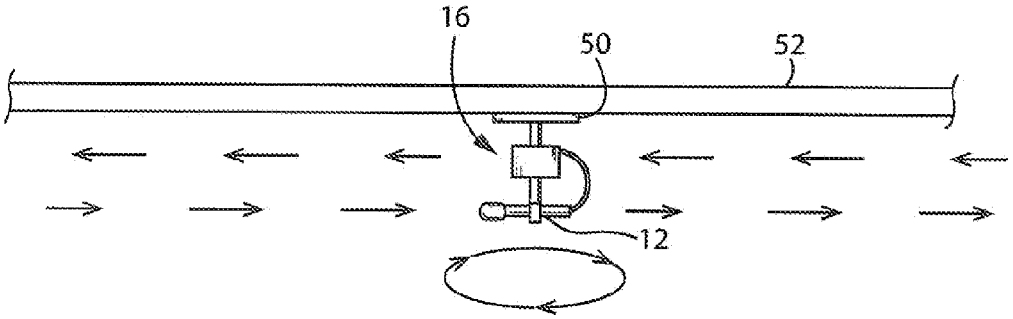
FIG. 5 is a schematic isometric view of a third embodiment of a microphone positioning system in accordance with the present invention.

FIG. 4 illustrates carrier 50, turntable assembly 16 and microphone 12 positioned above rail 52, with rail 52 being located in a lower or medium height location within the space. Referring to FIG. 5, rail 52 may also be positioned at a higher location within the space, such as adjacent a ceiling. When rail 52 is mounted in this manner, carrier 50 is located below rail 52 and turntable assembly 16 and microphone 12, in turn, are suspended from carrier 50. As in the embodiment shown in FIG. 4, the drive arrangement may be employed to move carrier 50 and thereby microphone 12 to any position along the length of rail 52. In addition, while not shown in the drawings, rail 52 may be oriented so as to extend vertically or at any other angle within the space, as desired. Rail 52 may be mounted to a wall or column, or may be placed in any other location within the space and supported at its upper and lower ends so as to extend vertically or oriented any other desired angle.

Figure 6:
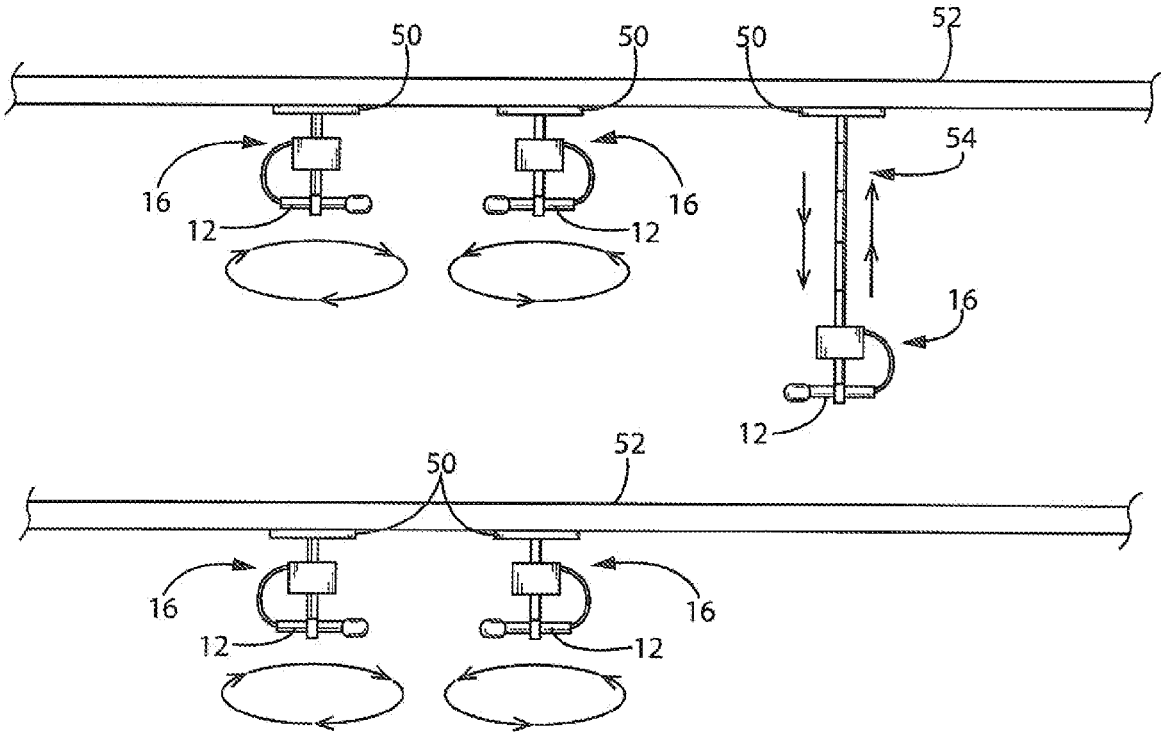
FIG. 6 is a schematic isometric view of a fourth embodiment of a microphone positioning system in accordance with the present invention.

As shown in FIG. 6, any number of rails 52 may be employed and any number of microphones 12 may be mounted to each rail 52 by an associated carrier 50. In addition, as also shown in FIG. 6 one or more of the turntable assemblies 16 and its associated microphone 12 may be mounted to an extendable and retractable support 54. Representatively, the extendable and retractable support 54 may be in the form of a telescoping pole or rod, which may be controlled in any satisfactory manner, such as via a worm gear, linear actuator, hydraulic cylinder or the like. In this manner, the vertical position of the associated microphone 12 can be varied as desired, in addition to the position of the microphone 12 along the length of rail 52 and the rotational angle of the microphone 12 as controlled by turntable assembly 16. This enables an operator to greatly vary the microphone position to ascertain the sound picked up by microphone 12 at a large number of positions within the plane defined by rail 52 and support 54, while varying the angle of the microphone 12 relative to the plane. The microphones 12 may be positioned so as to be in phase or out of phase with each other.

Figure 7:
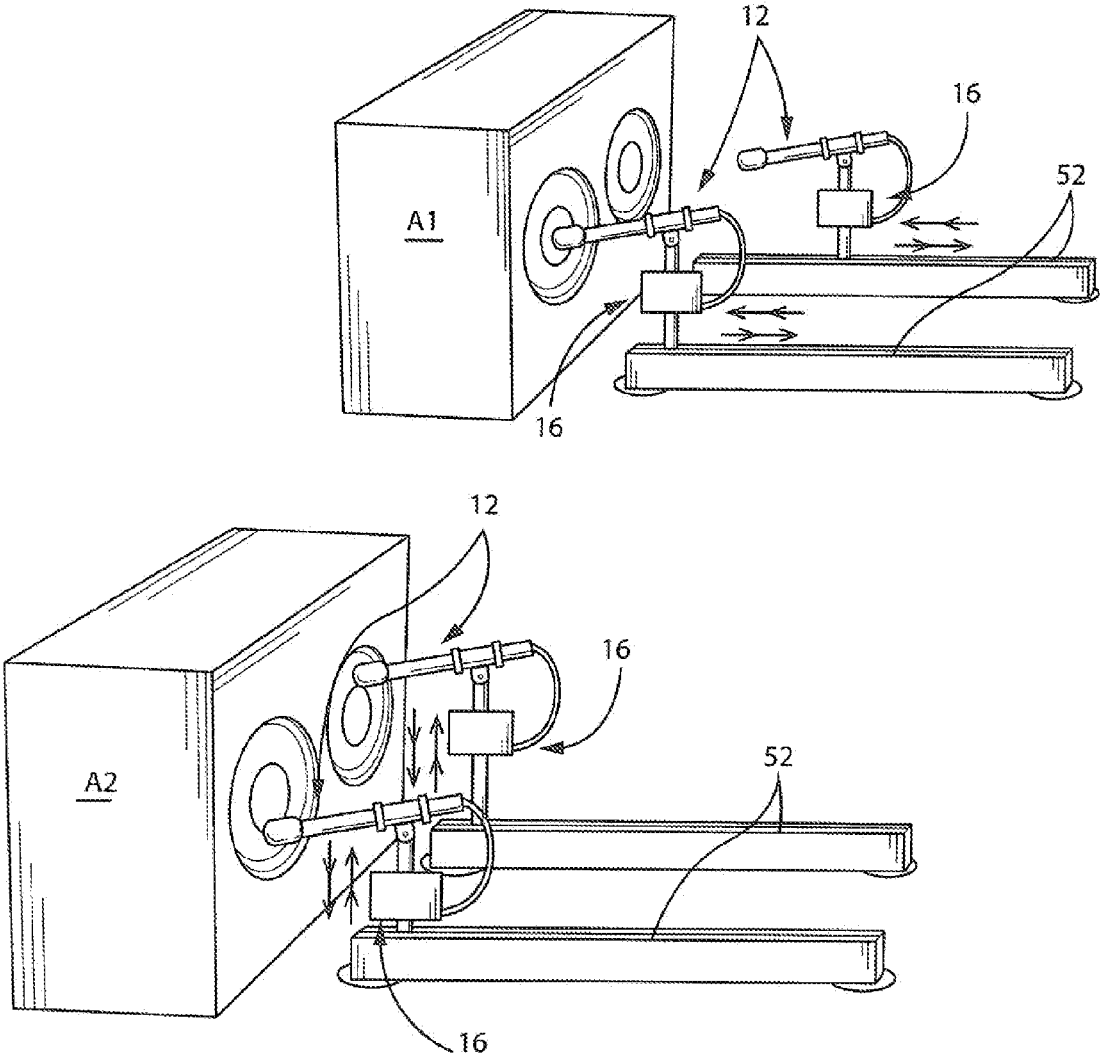
FIG. 7 is a schematic elevation view of a fifth embodiment of a microphone positioning system in accordance with the present invention.

FIG. 7 shows variations in which a pair of rails 52 are in alignment with a pair of audio output devices, such as speakers, associated with a first amplifier, shown at A1. In addition, a pair of rails 52 may be positioned in alignment with a pair of audio output devices, such as speakers, associated with a second amplifier, shown at A2. The axial positions of the microphones 16 relative to the output of amplifier A1 can be varied along the length of rails 52, either in tandem or in a staggered relationship, to enable the user to ascertain sounds at different locations of microphones 16 relative to the outputs of amplifier A1. Similarly, the same holds true with respect to microphones 16, picking up the outputs of amplifier A2, which adds the additional ability to vary the height of the microphones 12 using extendable and retractable supports 54.

Figure 8:
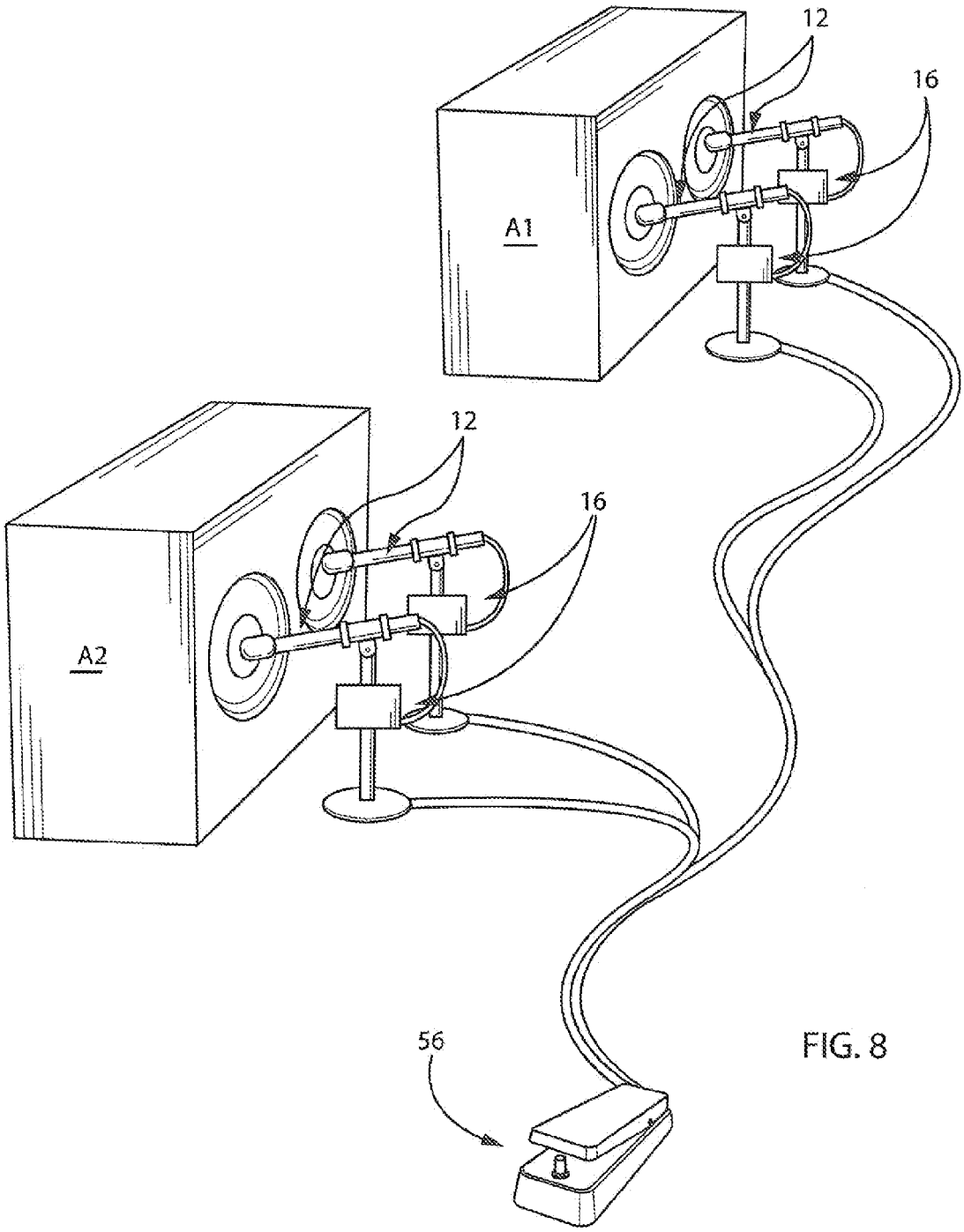
FIG. 8 is a schematic elevation view of a sixth embodiment of a microphone positioning system in accordance with the present invention.

FIG. 8 illustrates another embodiment in which a pair of microphones 12 are positioned adjacent the outputs of a pair of amplifiers A1 and A2, with one of each pair of microphones 12 being in phase and one of each pair of microphones 12 being out of phase.

In the embodiment of FIG. 8, the positions of microphones 12 can be controlled via a foot controller 56. It is understood, however, that the foot controller 56 may be used in any of the embodiments of the present invention for adjusting microphone position. Using foot controller 56, the user, such as an instrumentalist or vocalist, can vary the positions of microphones 12, while performing and without physically moving away from one location. The user is thus able to obtain real-time feedback as to sounds picked up in various microphone positions while performing, and to adjust microphone position to hear how the sounds change in various microphone positions. This flexibility and immediate response are extremely advantageous, providing a user with the ability to immediately observe sound variations and obtain a desired sound efficiently and effectively, while performing from a single location In another embodiment, not illustrated, a pair of non-parallel rails, such as 52 may be employed, in combination with a carrier such as 50 mounted at the intersection of the non-parallel rails. For example, a pair of generally horizontal rails 52 may be positioned within the space, and the rails 52, in turn, may be movable on tracks that support the rails 52 at their ends. A satisfactory drive mechanism may be employed to move the rails 52 along the tracks, to vary the location of intersection of the rails 52. In this manner, the microphone 12 supported by the carrier 50 can be moved to virtually any location within a horizontal plane parallel to the plane defined by the rails 52. Using an extendable and retractable support such as 54, a microphone 52 can thus be moved to virtually any location within the volume defined by the reach of the support 54, and the angle of the microphone 12 can be moved to any desired angle within the volume. This provides a user with a virtually unlimited ability to control the position of the microphone within the space.

While the microphone positioning system of the present invention has been shown and described with respect to hard-wired components, it is understood that the control signals may also be communicated wirelessly.

The microphone positioning system of the present invention allows a user to employ presets, i.e. predetermined microphone locations for certain conditions or applications. With suitable components and programming, a user is able to select a virtually unlimited number of preset microphone locations.

The drawings in the above description show turntable assembly 16 immediately below the microphone 12. It is also contemplated, however, that the microphone 12 may be mounted to a microphone stand and that the turntable assembly 16 may be at the bottom of the microphone stand shaft and supported by the base.

As an additional feature, it is contemplated that a video camera could be provided to provide a visual indication to the user as to the structure that the microphone 12 is facing. The video camera could be mounted to the microphone 12, and facing the same direction as microphone 12, or alternatively could be mounted to some other structure that rotates with turntable assembly 16 and that faces in the direction of the microphone 12.

While microphone positioning system 10 is particularly useful in a recording studio environment, it is also contemplated that microphone positioning system 10 may be employed in a live performance setting. In this regard, when used in a live performance setting, the microphone positioning system 10 can be employed to set desired sounds prior to the performance, and also to vary sounds real-time during a performance.

Various alternatives and embodiments are contemplated as being within the scope of the following claims particularly pointing out and distinctly claiming the subject matter regarded as the invention.

I claim:

1. A microphone positioning system for use within an area, comprising:

a microphone positioned in a first location within the area and supported by a microphone support;

a selectively operable rotatable device associated with the microphone support; and a manually operable remote control device positioned in a second location within the area that is spaced from the first location, wherein the manually operable remote control device is interconnected with the selectively operable rotatable device, and wherein the manually operable remote control device is responsive to manual operation by a user for selectively imparting rotation to the selectively operable rotatable device in response to manual inputs from the user to selectively vary the angle of the microphone, and wherein the microphone at the first location picks up sounds and, from the second location, the remote control device varies the angle of the microphone to vary the sounds picked up by the microphone at the first location.

2. The microphone positioning system of claim 1, further comprising a selectively operable elevation control device associated with the microphone support for varying the elevation of the microphone, wherein the manually operable remote control device is interconnected with the elevation control device for varying the elevation of the microphone.

3. The microphone positioning system: of claim 1, further comprising an axially extending rail, wherein the microphone support is movable to varying positions along the rail.

4. The microphone positioning system of claim 3, further comprising a drive arrangement interconnected between the rail and the microphone support for moving the microphone support along the rail, wherein the drive arrangement is operable in response to the manually operable remote control device.

5. The microphone positioning system of claim 4, further comprising a plurality of rails and one or more microphones mounted via a microphone support to each rail.

6. The microphone positioning system of claim 1, wherein the manually operable remote control device comprises a foot-operated controller.

7. A method of positioning a microphone within an area, comprising the acts of:

providing a microphone in a first location within the area, supporting the microphone by a microphone support that includes a selectively operable rotatable device;

selectively imparting rotation to the selectively operable rotatable device from a second location within the area that is remote from the first location using a manually operable remote control device positioned in the second location; and picking up sounds by the microphone at the first location, and from the second location, varying the angle of the microphone using the manually operable remote control device to vary the sounds picked up by the microphone at the first location, wherein said selectively imparting rotation to the selectively operable rotatable device includes selectively varying the angle of the microphone in response to manual input from a user.

8. The method of claim 7, wherein the microphone support further includes an elevation control device, and further comprising the act of varying the elevation of the microphone using the elevation control device by operation of the manually operable remote control device.

9. The method of claim 8, further comprising the act of selectively moving the microphone support along an axially extending rail located within the area by operation of the manually operable remote control device.

10. The method of claim 9, wherein the act, of selectively moving the microphone support along the axially extending rail is carried out via a drive arrangement interconnected between the rail and the microphone support for moving the microphone support along the rail, wherein the drive arrangement is operable in response to manual operation of the manually operable remote control device from the second location.

11. The method of claim 10, further comprising a plurality of rails and one or more microphones mounted via a microphone support to each rail.

12. The method of claim 9, wherein the manually operable remote control device comprises a foot-operated controller.

13. The microphone positioning system of claim 3, wherein the area is defined by one or more walls, and wherein the axially extending rail is arranged relative to at least one of the walls such that the microphone can be positioned to point toward the at least one wall to pick up sounds reflected off the at least one wall.

14. The method of claim 9, wherein the area is defined by one or more walls, and further comprising the act of positioning the microphone on the rail so as to point toward the at least one wall to pick up sounds reflected off the at least one wall.

* * * * *